US010223964B2

(12) United States Patent
Han

(10) Patent No.: US 10,223,964 B2
(45) Date of Patent: Mar. 5, 2019

(54) ORGANIC LIGHT-EMITTING DISPLAY APPARATUS AND METHOD OF DRIVING THE SAME

(71) Applicant: SAMSUNG DISPLAY CO., LTD., Yongin, Gyeonggi-Do (KR)

(72) Inventor: Sangmyeon Han, Yongin (KR)

(73) Assignee: SAMSUNG DISPLAY CO., LTD., Yongin, Gyeonggi-do (KR)

( * ) Notice: Subject to any disclaimer, the term of this patent is extended or adjusted under 35 U.S.C. 154(b) by 592 days.

(21) Appl. No.: 14/827,629

(22) Filed: Aug. 17, 2015

(65) Prior Publication Data

US 2016/0203759 A1 Jul. 14, 2016

(30) Foreign Application Priority Data

Jan. 14, 2015 (KR) ..... 10-2015-0006974

(51) Int. Cl.
*G09G 3/3233* (2016.01)

(52) U.S. Cl.
CPC ... *G09G 3/3233* (2013.01); *G09G 2300/0819* (2013.01); *G09G 2300/0852* (2013.01); *G09G 2300/0866* (2013.01); *G09G 2320/045* (2013.01)

(58) Field of Classification Search
CPC ..... G09G 3/3233; G09G 2302/045; G09G 2300/0819; G09G 2300/052; G09G 2300/0866
See application file for complete search history.

(56) References Cited

U.S. PATENT DOCUMENTS

2007/0126665 A1 6/2007 Kimura
2009/0073092 A1* 3/2009 Numao ..... G09G 3/3233 345/76
2010/0127956 A1 5/2010 Kang et al.
2011/0025586 A1 2/2011 Lee
2011/0148937 A1* 6/2011 Park ..... G09G 3/3233 345/690
2011/0285691 A1 11/2011 Takasugi et al.
2012/0050274 A1* 3/2012 Yoo ..... G09G 3/003 345/419
2012/0146999 A1* 6/2012 Hwang ..... G09G 3/003 345/419
2014/0347401 A1* 11/2014 Hwang ..... G09G 3/3233 345/690

FOREIGN PATENT DOCUMENTS

JP 2007-179042 7/2007
KR 10-2010-0059318 6/2010
KR 10-2011-0013692 2/2011
KR 10-2011-0127006 11/2011
KR 10-2014-0035724 A 3/2014

* cited by examiner

*Primary Examiner* — David Tung
(74) *Attorney, Agent, or Firm* — Lee & Morse, P.C.

(57) ABSTRACT

An organic light-emitting display apparatus includes a pixel and a power supply. The pixel is connected to a scan line, a data line, and a power line and includes an organic light-emitting diode to emit light based on a first data voltage. The power supply applies different levels of power to the pixel during one frame. The pixel holds a second data voltage to be used during a next frame when the organic light-emitting diode emits light based on the first data voltage during the one frame.

4 Claims, 8 Drawing Sheets

ORGANIC LIGHT-EMITTING DISPLAY APPARATUS AND METHOD OF DRIVING THE SAME

CROSS-REFERENCE TO RELATED APPLICATION

Korean Patent Application No. 10-2015-0006974, filed on Jan. 14, 2015, and entitled, "Organic Light-Emitting Display Apparatus and Method of Driving the Same," is incorporated by reference herein in its entirety.

BACKGROUND

1. Field

One or more embodiments described herein relate to an organic light emitting display apparatus and a method for driving an organic light emitting display apparatus.

2. Description of the Related Art

An organic light-emitting display generates images using a plurality of pixels. Each pixel includes an organic light-emitting diode that generates light based on a recombination of electrons and holes in an organic emission layer. In order to generate images, control and other types of signals are supplied to the pixels through scan lines, data lines, and power lines. When a voltage drop occurs in the power lines (e.g., based on locations of the pixels), the display brightness may be adversely affected, e.g., become non-uniform.

SUMMARY

In accordance with one or more embodiments, an organic light-emitting display apparatus includes a pixel connected to a scan line, a data line, and a power line and including an organic light-emitting diode to emit light based on a first data voltage; and a power supply to apply different levels of power to the pixel during one frame, wherein the pixel is to hold a second data voltage to be used during a next frame when the organic light-emitting diode is to emit light based on the first data voltage during the one frame.

The pixel may include a first transistor connected between the data line and a first node and to turn on based on a reset control signal; a second transistor connected between the first node and a second node and to turn on based on an emission control signal; a third transistor connected to a first power source and a third node and to supply a driving current to the organic light-emitting diode based on the first data voltage; a fourth transistor connected between the second node and a fourth node and to turn on based on a write control signal; a fifth transistor connected between the data line and the fourth node and to turn on based on a scan signal; a first capacitor connected between the first node and the third node; and a second capacitor connected between a reference power source and the fourth node, wherein the organic light-emitting diode has an anode connected to the third node and a cathode connected to a second power source.

The first capacitor may be charged based on a reset voltage from the data line, the first data voltage, and a threshold voltage of the third transistor when the first transistor and the fourth transistor are turned on.

The pixel may include a first transistor connected between a reference power source and a first node and to turn on based on a reset control signal; a second transistor connected between the first node and a second node and to turn on based on an emission control signal; a third transistor connected to a first power source and a third node and to supply a driving current to the organic light-emitting diode based on the first data voltage; a fourth transistor connected between the second node and a fourth node and to turn on based on a write control signal; a fifth transistor connected between the data line and the fourth node and to turn on based on a scan signal; a first capacitor connected between the first node and the third node; and a second capacitor connected between the reference power source and the fourth node, wherein the organic light-emitting diode has an anode connected to the third node and a cathode connected to a second power source.

The first capacitor may be charged based on a reference voltage supplied from the reference power source, the first data voltage, and a threshold voltage of the third transistor when the first transistor and the fourth transistor are turned on.

The pixel may include a first transistor connected between a set power source and a first node and to turn on based on a reset control signal; a second transistor connected between the first node and a second node and to turn on based on an emission control signal; a third transistor connected to a first power source and a third node and to supply a driving current to the organic light-emitting diode based on the first data voltage; a fourth transistor connected between the second node and a fourth node and to turn on based on a write control signal is supplied; a fifth transistor connected between the data line and the fourth node and to turn on based on a scan signal is supplied; a first capacitor connected between the first node and the third node; and a second capacitor connected between the reference power source and the fourth node, wherein the organic light-emitting diode has an anode connected to the third node and a cathode connected to a second power source.

The first capacitor may be charged based on a set voltage supplied from the set power source, the first data voltage, and a threshold voltage of the third transistor when the first transistor and the fourth transistor are turned on. The second capacitor may be charged based on the second data voltage when the fifth transistor is turned on.

The pixel may include a first transistor connected between the data line and a first node and to turn on based on a reset control signal is supplied; a second transistor connected between the first node and a second node and to turn on based on an emission control signal is supplied; a third transistor connected to a first power source and a third node and to supply a driving current to the organic light-emitting diode based on the first data voltage; a fourth transistor connected between the second node and a fourth node and to turn on based on a write control signal is supplied; a fifth transistor connected between a reference power source and the fourth node and to turn on based on a scan signal is supplied; a first capacitor connected between the first node and the third node; and a second capacitor connected between the data line and the fourth node, wherein the organic light-emitting diode has an anode connected to the third node and a cathode connected to a second power source.

The first capacitor may be charged based on a reference voltage supplied from the reference power source, a reset voltage supplied from the data line, the first data voltage, and a threshold voltage of the third transistor when the first transistor and the fourth transistor are turned on. The second capacitor may be charged based on the reference voltage supplied from the reference power source and the second data voltage when the fifth transistor is turned on. The first through fifth transistors may be Negative Metal Oxide Semiconductor (NMOS) transistors.

In accordance with one or more other embodiments, a method for driving an organic light-emitting display apparatus includes resetting a data voltage applied to a gate electrode of a driving transistor; applying a first data voltage to the gate electrode of and compensating for a threshold voltage of the driving transistor; emitting light from an organic light-emitting diode with a brightness based on the first data voltage; and holding a second data voltage, wherein the first data voltage is used during a first frame, the second data voltage is used during a second frame, the second frame is adjacent to the first frame, and emitting the light and holding the second data voltage are performed simultaneously.

Resetting the data voltage may include applying a reset voltage from a data line to the gate electrode of the driving transistor, compensating for the threshold voltage may include storing a voltage based on the reset voltage, the first data voltage, and the threshold voltage to supply the driving current, and emitting the light may include supplying the reset voltage and a driving current according to the first data voltage to the organic light-emitting diode.

Resetting the data voltage may include applying a reference voltage to the gate electrode of the driving transistor, compensating the threshold voltage may include storing a voltage based on the reference voltage, the first data voltage, and the threshold voltage to supply the driving current, and emitting the light may include supplying the reference voltage and a driving current according to the first data voltage to the organic light-emitting diode.

Resetting the data voltage may include applying a set voltage to the gate electrode, compensating the threshold voltage may include storing a voltage based on the set voltage, the first data voltage, and the threshold voltage to supply the driving current, and emitting the light may include supplying the set voltage and a driving current according to the first data voltage to the organic light-emitting diode.

Resetting the data voltage may include applying a reset voltage from a data line to the gate electrode, compensating the threshold voltage may include storing a voltage based on the reset voltage, a reference voltage received according to the scan signal, the first data voltage, and the threshold voltage to supply the driving current, and emitting the light may include supplying the first data voltage and a driving current according to the reference voltage to the organic light-emitting diode.

The method may include simultaneously applying a first power, a scan signal, a control signal, and a data signal to all pixels for one or more of the resetting, applying, emitting, or holding, one or more of the first power, the scan signal, the control signal, and the data signal having a preset voltage level. The driving transistor may be an NMOS transistor.

BRIEF DESCRIPTION OF THE DRAWINGS

Features will become apparent to those of skill in the art by describing in detail exemplary embodiments with reference to the attached drawings in which.

DETAILED DESCRIPTION

Figure 1:
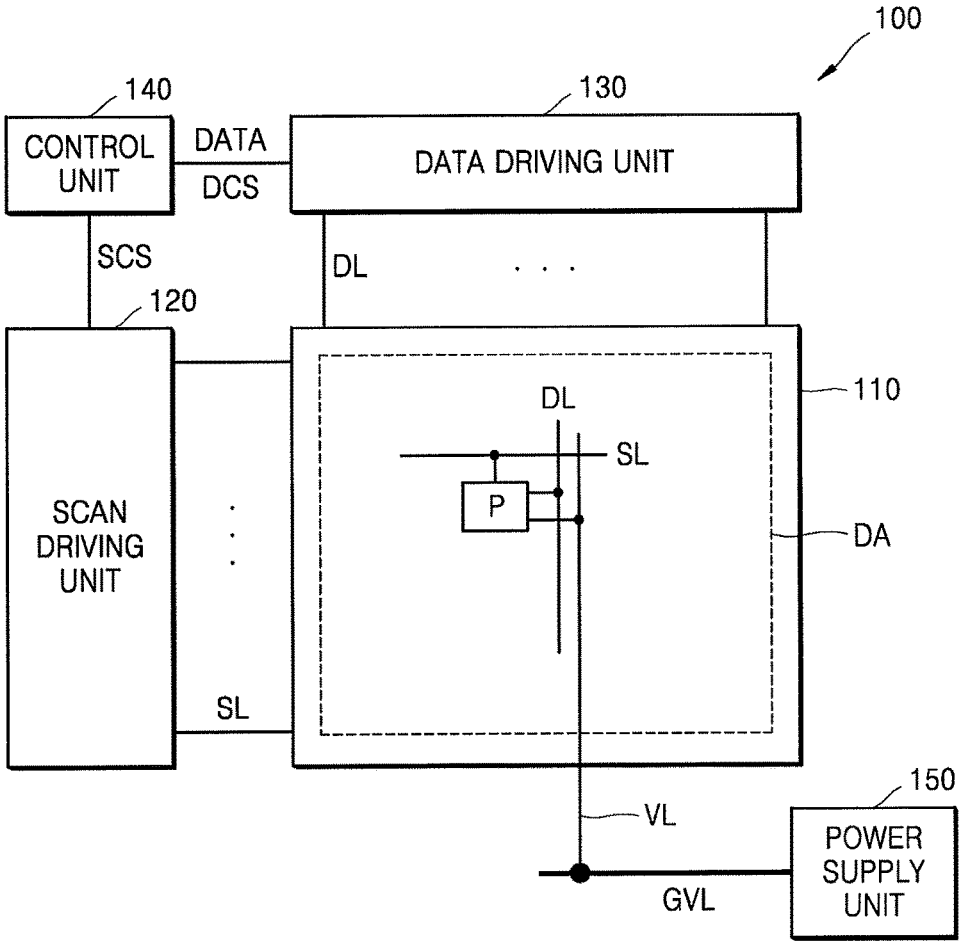
FIG. 1 illustrates an embodiment of an organic light emitting display apparatus.

Example embodiments are described more fully hereinafter with reference to the accompanying drawings; however, they may be embodied in different forms and should not be construed as limited to the embodiments set forth herein. Rather, these embodiments are provided so that this disclosure will be thorough and complete, and will fully convey exemplary implementations to those skilled in the art. The embodiments may be combined to form additional embodiments. Like reference numerals refer to like elements throughout.

FIG. 1 illustrates an embodiment of an organic light emitting display apparatus 100 which includes a display panel 110, a scan driving unit 120, a data driving unit 130, a control unit 140, and a power supply unit 150.

The display panel 110 may operate in a digital driving manner and includes pixels P, scan lines SL, data lines DL, and power lines VL. The pixels P are arranged in a first (e.g. column) direction and a second (e.g., row) direction to form a matrix. The data lines DL are connected to the pixels P and extend in the column direction. Each data line DL transmits data signals DATA to pixels P in a same column. The scan lines SL are connected to the pixels P and are arranged in the row direction. Each scan line transmits a scan signal to pixels P in a same row.

The power lines VL extend in the column direction and transmit a power supply voltage to the pixels P. Each power line VL transmits the power supply voltage to pixels P in a same column. In another embodiment, the power lines VL may extend in the row direction. In this case, each power line VL may be connected to pixels P in a same row and may transmit a power supply voltage to the pixels P in that row.

The pixels P are arranged in a display area DA. Each power line VL receives a power supply voltage through a global power line GVL outside the display area DA. The global power line GVL receives a power supply voltage from the power supply unit 150 and transmits the power supply voltage to a corresponding power line VL. The global power line GVL may be, for example, a film line or a wire.

The data signal DATA may be a digital signal having an on level or an off level. A pixel P emits light or does not emit light based on the level of the digital signal. In one embodiment, a pixel P emits light when the digital data signal has an on level and does not emit light when the digital data signal has an off level. The on level may be a high level and the off level may be a low level. In another embodiment, the opposite may be true, e.g., a pixel P emits light when the digital data signal has an off level and does not emit light when the digital data signal has an on level.

Thus, the emission state of each pixel P may be described as corresponding to a state where light is emitted or a state where light is not emitted. When the organic light-emitting display apparatus 100 operates in a digital driving manner, one frame includes a plurality of subfields and the length (for example, a display duration) of each subfield is determined according to a weight set to each subfield. Each subfield may include an on-level or off-level image signal. In another embodiment, the organic light-emitting display apparatus may operate in an analog driving manner.

Each of the pixels P may include an emission device connected to a pixel circuit.

The controller 140 receives image data from an external source and controls the scan driving unit 120 and the data driving unit 130. The controller 140 generates control signals (e.g., a scan control signal SCS and a data control signal DCS) and digital data. The controller 140 provides the scan control signal SCS to the scan driving unit 120 and the data control signal DCS and the digital data to the data driving unit 130.

The scan driving unit 120 drives the scan lines SL in a predetermined order based on the scan control signal SCS. For example, the scan driving unit 120 may generate and provide a scan signal to the pixels P via the scan lines SL.

The power supply unit 150 applies different levels of power to the pixels P for one frame.

The data driving unit 130 drives data lines DL based on the data control signal DCS and the digital data. The data driving unit 130 may generate data signals DATA respectively corresponding to the data lines DL and provide the data signals DATA to the pixels P via the data lines DL.

In one embodiment, the organic light-emitting display apparatus 100 is driven in a simultaneous emission manner. For example, data may be sequentially input during one frame. After the data inputs are completed, light corresponding to the data of one frame is simultaneously emitted from all the pixels P in the display area DA. Thus, data inputs may be sequentially performed and light emission from al the pixels may be simultaneously performed after the data inputs are completed.

Figure 2:
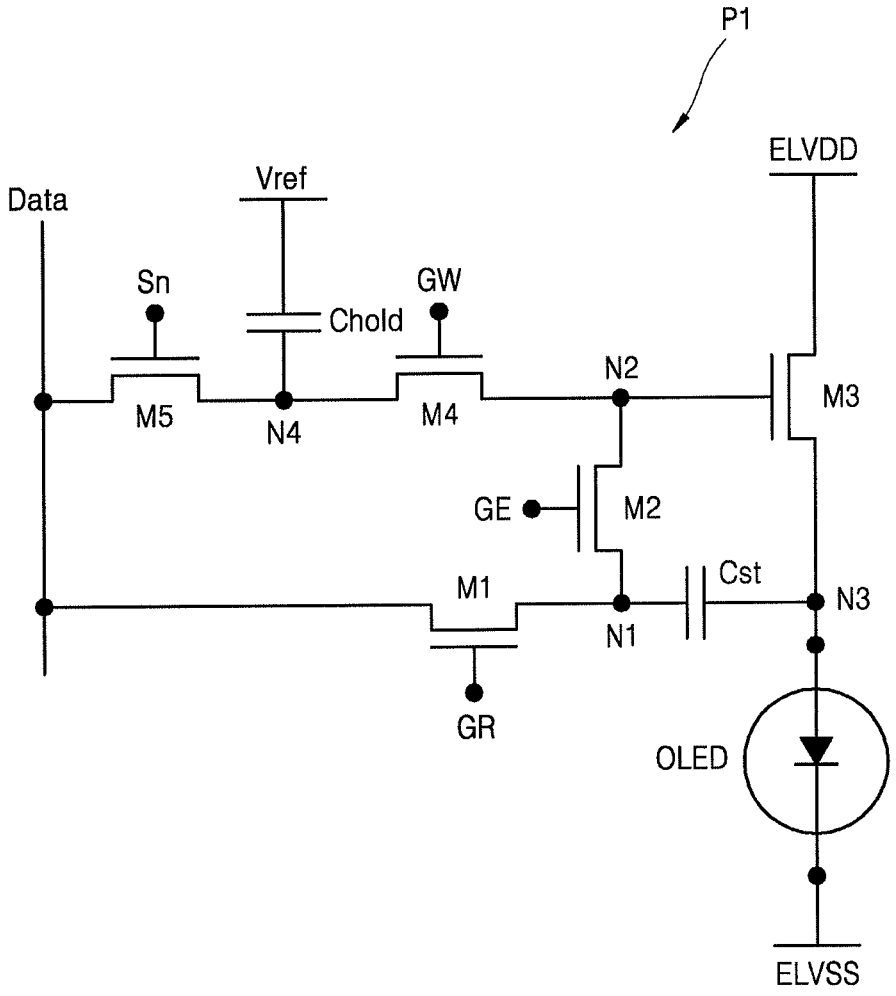
FIG. 2 illustrates an embodiment of a pixel.

FIG. 2 illustrates an embodiment of a pixel P1, which, for example, may be included in the organic light emitting display apparatus 100 of FIG. 1. Referring to FIG. 2, the pixel P1 includes a pixel circuit for supplying current to an organic light-emitting diode OLED. For convenience of explanation, it is assumed that the pixel P1 of FIG. 2 is connected to an n-th scan line and an m-th data line.

The pixel circuit includes first through fifth transistors M1 through M5 and first and second capacitors Cst and Chold. The organic light-emitting diode OLED has an anode connected to the pixel circuit and a cathode connected to receive a second power ELVSS. The organic light-emitting diode OLED may emit light with a predetermined brightness based on current from the pixel circuit.

The first transistor M1 has a first electrode connected to a data line DL and a second connected to a first node N1. The first transistor M1 is turned on when a reset control signal GR is supplied and electrically connects the data line DL to the first node N1. The first and second electrodes are drain and source electrodes, or vice versa.

The second transistor M2 has a first electrode connected to the first node N1 and a second electrode connected to a second node N2. The second transistor M2 is turned on when an emission control signal GE is supplied and electrically connects the first node N1 to the second node N2.

The third transistor M3 has a gate electrode connected to the second node N2, a first electrode connected to a third node N3, and a second electrode connected to a first power ELVDD. The third transistor M3 supplies a driving current to the organic light-emitting diode OLED for one frame, based on a first data voltage.

The fourth transistor M4 has a first electrode connected to a fourth node N4 and a second electrode connected to the second node N2. The fourth transistor M4 is turned on when a write control signal GW is supplied and electrically connects the second node N2 to the fourth node N4.

The fifth transistor M5 has a first electrode connected to the data line DL and a second electrode connected to the fourth node N4. The fifth transistor M5 is turned on when a scan signal Sn is supplied and electrically connects the data line DL to the fourth node N4.

The first capacitor Cst has a first end connected to the first node N1 and a second end connected to the third node N3. The second capacitor Chold has a first end connected to a reference power source Vref and a second end connected to the fourth node N4.

Figure 3:
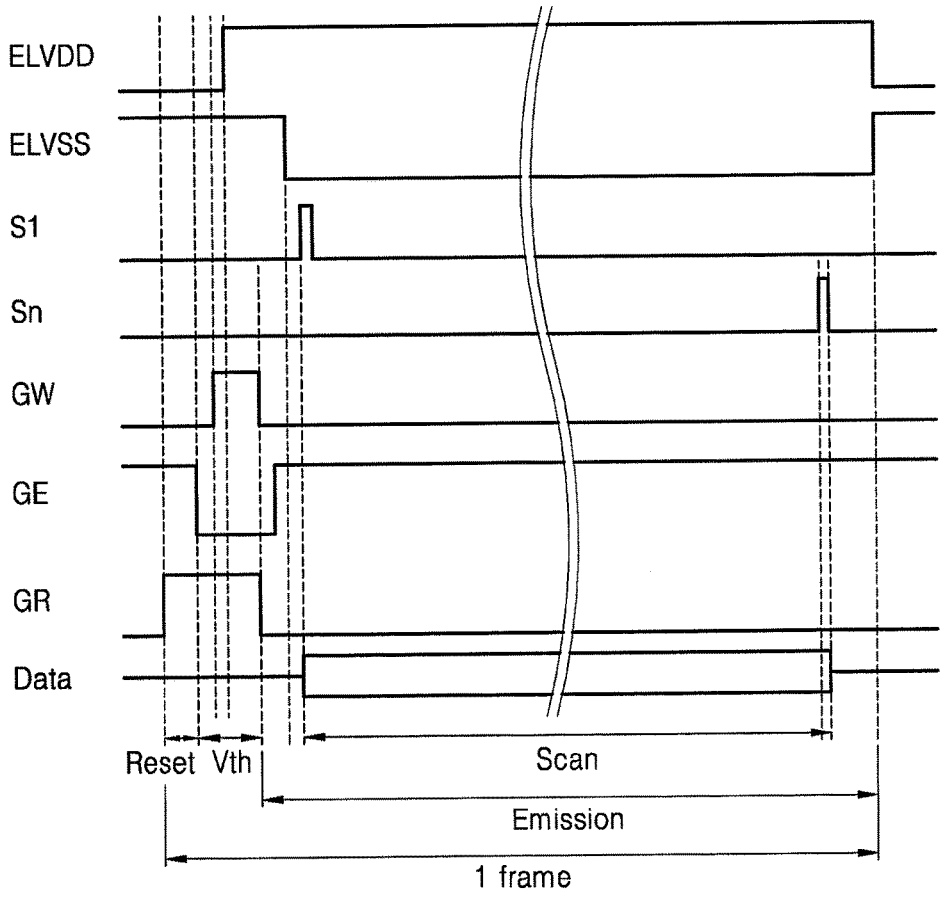
FIG. 3 illustrates an example of control signals for the pixel.

FIG. 3 is a timing diagram illustrating an example of control signals for pixels pf the display panel 110, where the pixels may have, for example, the configuration of FIG. 2. Referring to FIG. 3, one frame is divided into a reset section Reset, a threshold voltage compensation section Vth, a scan and data-input section Scan, and an emission section Emission.

In the scan and data-input section Scan, a scan signal is sequentially input to scan lines and data signals Data are sequentially input to respective pixels P. However, in the reset section Reset, the threshold voltage compensation section Vth, and the emission section Emission, signals having preset levels of voltage values (e.g., a first power ELVDD, a scan signal Sn, a reset control signal GR, an emission control signal GE, a write control signal GW, and a data signal Data) are simultaneously applied to all of the pixels of the display panel 110.

During the reset section Reset, the second power ELVSS, the emission control signal GE, and the reset control signal GR are applied with high levels, the first power ELVDD, the scan signal Sn, and the write control signal GW are applied with low levels, and the data signal Data is applied as, for example, a reset voltage Vsus. Thus, in the reset section Reset, the first transistor M1 and the second transistor M2 are turned on and the reset voltage Vsus is applied to each of the first node N1 and the second node N2.

The reset voltage Vsus may be a predetermined voltage for turning on the third transistor M3. As the reset voltage Vsus is applied to the gate electrode of the third transistor M3, the first power ELVDD is applied to the third node N3. As a first power ELVDD of a low level is applied to the third node N3 and a second power ELVSS of a high level is applied to the third node N3, the first capacitor Cst is charged based on the reset voltage Vsus.

In the reset section Reset, since the second power ELVSS of a high level has been applied, the organic light-emitting diode OLED does not emit light. As such, in the reset section Reset, a data voltage applied to the pixel P1 of the organic light-emitting display apparatus 100 is reset. Thus, the reset section Reset may include an operation for resetting a storage capacitor and dropping a voltage of the anode of the OLED to no more than a voltage of its cathode, so that the organic light-emitting diode OLED does not emit light.

During the threshold voltage compensation section Vth, the first power ELVDD, the second power ELVSS, the write control signal GW, and the reset control signal GR are applied with high levels, the scan signal Sn and the emission control signal GE are applied with low levels, and the data signal Data is applied as, for example, the reset voltage Vsus. Thus, during the threshold voltage compensation section Vth, the first transistor M1 and the fourth transistor M4 are turned on and thus the reset voltage Vsus is applied to the first node N1, and the second node N2 is electrically connected to the fourth node N4 and thus a voltage of the fourth node N4 is applied to second node N2.

When the organic light-emitting display apparatus 100 is driven in a simultaneous emission manner, a first data voltage Vdata1 is held in the second capacitor Chold, during a previous frame, so that the first data voltage Vdata1 may be used during a current frame. The first data voltage Vdata1 held in the second capacitor Chold is applied to the second node N2, since the fourth transistor M4 is turned on during the threshold voltage compensation section Vth. As the first data voltage Vdata1 is applied to the second node N2, the third transistor M3 is turned on.

During the threshold voltage compensation section Vth, since the level of the first power ELVDD changes from a low level to a high level, current flows via the third transistor M3 and a voltage based on the difference (Vdata1−Vth) between a voltage of the second node N2 and a threshold voltage of the third transistor M3 is applied to the third node N3.

As a result, the first capacitor Cst is charged based on a difference (Vsus−(Vdata1−Vth)) between the reset voltage Vsus applied to the first node N1 and the voltage (Vdata1−Vth) applied to the third node N3. For example, the first capacitor Cst stores a voltage based on the reset voltage Vsus, the first data voltage Vdata1, and the threshold voltage Vth of the third transistor M3, during the threshold voltage compensation section Vth.

As such, in the threshold voltage compensation section Vth, a threshold voltage of a driving transistor in the pixel P1 is stored in the capacitor. Thus, the threshold voltage compensation section Vth may include an operation of addressing brightness non-uniformity due to characteristic deviation of the driving transistor. The organic light-emitting display apparatus 100 may include, for example, an Negative Metal Oxide Semiconductor (NMOS) transistor as the driving transistor and thus may compensate for the threshold voltage of the driving transistor even when the threshold voltage has a negative value.

During the emission section Emission, the first power ELVDD and the emission control signal GE are applied with high levels, the second power ELVSS, the write control signal GW, and the reset control signal GR are applied with low levels, and the data signal Data is applied as, for example, a second data voltage Vdata2. Thus, in the emission section Emission, the second transistor M2 is turned on and a voltage of the first capacitor Cst is maintained equal to the voltage charged in the voltage compensation section Vth. Also, a voltage (Vsus−(Vdata1−Vth)) of the first capacitor Cst is applied between the second node N2 and the third node N3, namely, between a gate electrode and a source electrode of the third transistor M3.

In the emission section Emission, the first data voltage Vdata1 is applied to the second node N2 and thus the third transistor M3 is turned on. The first power ELVDD is applied with a high level and the second power ELVSS is applied with a low level, and the third transistor M3 supplies a driving current to the organic light-emitting diode OLED, based on the first data voltage Vdata1. The driving current may be calculated based on Equation 1.

$$I = K(Vgs - Vth)^2 = K(Vsus - (Vdata1 - Vth) - Vth)^2 = K(Vsus - Vdata)^2 \quad (1)$$

$$K = \frac{1}{2} \times Cox \times \mu \times \frac{W}{L}$$

where K indicates a constant, Cox indicates a gate capacitance, μ indicates the mobility of hole, W indicates a channel width of a driving transistor, and L indicates a channel length of the driving transistor.

As such, the pixel emits light based on the reset voltage Vsus and the first data voltage Vdata1, which are irrelevant to the first voltage ELVDD or the threshold voltage of the driving transistor, thereby increasing uniformity of brightness of the organic light-emitting display apparatus 100.

According to an embodiment, only the driving transistor and the organic light-emitting diode OLED are formed between the first power ELVDD and the second power ELVSS, and thus power consumption for emission is reduced.

During the scan and data-input section Scan, the first power ELVDD and the emission control signal GE are applied with high levels, the second power ELVSS, the write control signal GW, and the reset control signal GR are applied with low levels, and the data signal Data is applied as, for example, the second data voltage Vdata2. When the scan signals S1 through Sn are sequentially input to the scan lines SL respectively, the data signals Data are sequentially input to the pixels P respectively.

In the scan and data-input section Scan, the second capacitor Chold holds the second data voltage Vdata2 in order to use the second data voltage Vdata2 during a next frame, for example, in order to apply the second data voltage Vdata2 to the second node N2 in a threshold voltage compensation section Vth of the next frame. Thus, the second capacitor Chold may be based on the second data voltage Vdata2 when the fifth transistor M5 is turned on.

Figure 4:
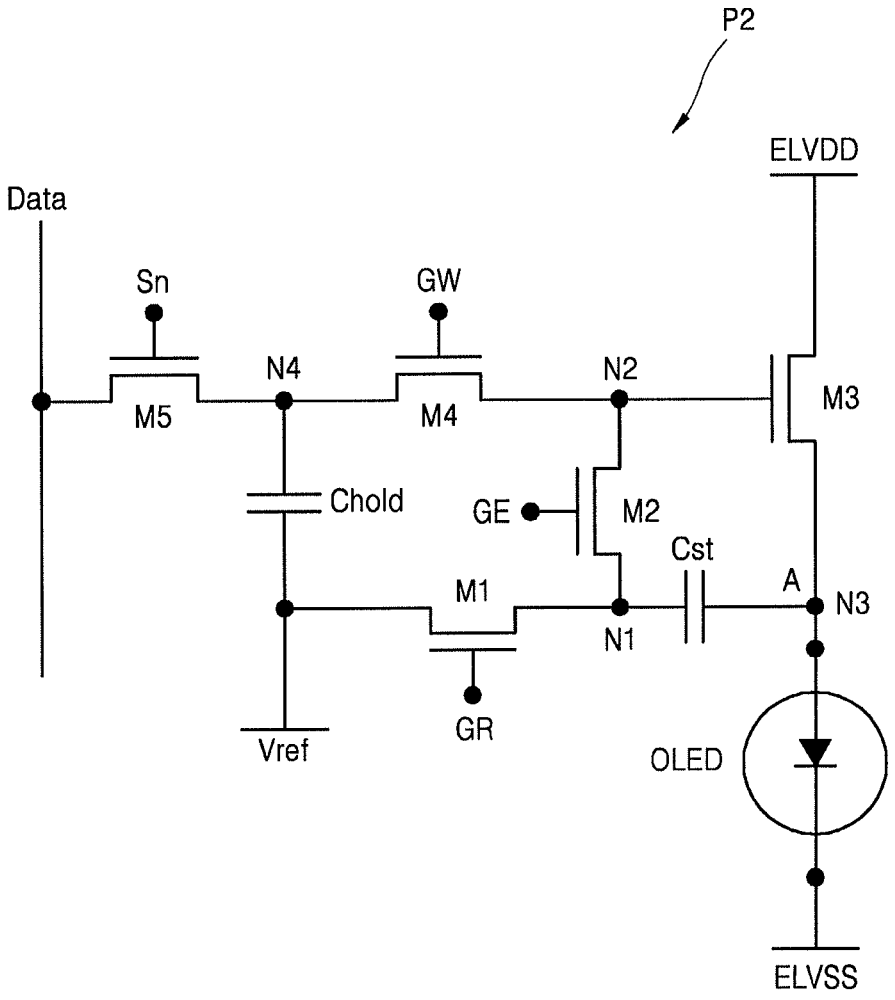
FIG. 4 illustrates another embodiment of a pixel.

FIG. 4 illustrates another embodiment of a pixel P2, which, for example, may be included in the organic light emitting display apparatus 100 of FIG. 1. Referring to FIG. 4, the pixel P2 includes an organic light-emitting diode OLED and first through fifth transistors M1 through M5 and first and second capacitors Cst and Chold for supplying a current to the organic light-emitting diode OLED.

A first transistor M1 has a first electrode to receive a reference voltage Vref and a second electrode connected to a first node N1. The first transistor M1 is turned on when a reset control signal GR is supplied, and the reference voltage Vref is supplied to the first node N1.

A second transistor M2 has a first electrode connected to the first node N1 and a second electrode connected to a second node N2. The second transistor M2 is turned on when an emission control signal GE is supplied and electrically connects the first node N1 to the second node N2.

A third transistor M3 has a gate electrode connected to the second node N2, a first electrode connected to a third node N3, and the third transistor M3 to receive a first power ELVDD through its second electrode.

A fourth transistor M4 has a first electrode connected to a fourth node N4 and a second electrode connected to the second node N2. The fourth transistor M4 is turned on when a write control signal GW is supplied and electrically connects the second node N2 to the fourth node N4.

A fifth transistor M5 has a first electrode connected to the data line DL and a second electrode connected to the fourth node N4. The fifth transistor M5 is turned on when a scan signal Sn is supplied and electrically connects the data line DL to the fourth node N4.

The first capacitor Cst has a first end connected to the first node N1 and a second end connected to the third node N3. The second capacitor Chold has a first end connected to the reference voltage Vref and a second end connected to fourth node N4.

In the reset section Reset, the first transistor M1 and the second transistor M2 are turned on and thus a reference voltage Vref is applied to each of the first node N1 and the second node N2. In one embodiment, the reference voltage Vref may denote an external signal other than a signal that is received from a data line DL.

The reference voltage Vref may be a predetermined voltage for turning one the third transistor M3. As the reference voltage Vref is applied to the gate electrode of the third transistor M3, the first power ELVDD is applied to the third node N3.

During the reset section Reset, the first capacitor Cst is reset as the reference voltage Vref and the organic light-emitting diode OLED does not emit light.

During the threshold voltage compensation section Vth, the first transistor M1 and the fourth transistor M4 are turned on and thus the reference voltage Vref is applied to the first node N1. Also, the second node N2 is electrically connected to the fourth node N4 and thus a voltage of the fourth node N4 is applied to the second node N2.

The first data voltage Vdata1 held in the second capacitor Chold during a previous frame is applied to the second node N2, since the fourth transistor M4 is turned on during the threshold voltage compensation section Vth. As the first data voltage Vdata1 is applied to the second node N2, the third transistor M3 is turned on and current flows via the third transistor M3. A voltage based on the difference (Vdata1−Vth) between a voltage of the second node N2 and the threshold voltage of the third transistor M3 is applied to the third node N3.

As a result, the first capacitor Cst is charged based on a difference (Vref−(Vdata1−Vth)) between the reference voltage Vref applied to the first node N1 and the voltage (Vdata1−Vth) applied to the third node N3. Thus, the first capacitor Cst is charged based on the reference voltage Vref, the first data voltage Vdata1, and the threshold voltage Vth of the third transistor M3 during the threshold voltage compensation section Vth.

During the emission section Emission, the second transistor M2 is turned on and thus a voltage of the first capacitor Cst is maintained equal to the voltage charged in the voltage compensation section Vth. Also, a voltage (Vref−(Vdata1−Vth)) of the first capacitor Cst is applied between the second node N2 and the third node N3, namely, between a gate electrode and a source electrode of the third transistor M3.

In the emission section Emission, the first data voltage Vdata1 is applied to the second node N2 and thus the third transistor M3 is turned on. The first power ELVDD is applied with a high level and the second power ELVSS is applied with a low level, and the third transistor M3 supplies a driving current to the organic light-emitting diode OLED, based on the first data voltage Vdata1. The driving current may be calculated based on Equation 2.

$$I=K(V\text{ref}-V\text{data1})^2 \quad (2)$$

As such, the pixel emits light based on the reference voltage Vref and the first data voltage Vdata1, which are irrelevant to the first voltage ELVDD or the threshold voltage of the driving transistor, thereby increasing uniformity of brightness.

During the scan and data-input section Scan, the second capacitor Chold holds the second data voltage Vdata2 in order to use the second data voltage Vdata2 during a next frame, for example, in order to apply the second data voltage Vdata2 to the second node N2 in a threshold voltage compensation section Vth of the next frame. Thus, the second capacitor Chold may be based on the second data voltage Vdata2 when the fifth transistor M5 is turned on.

Figure 5:
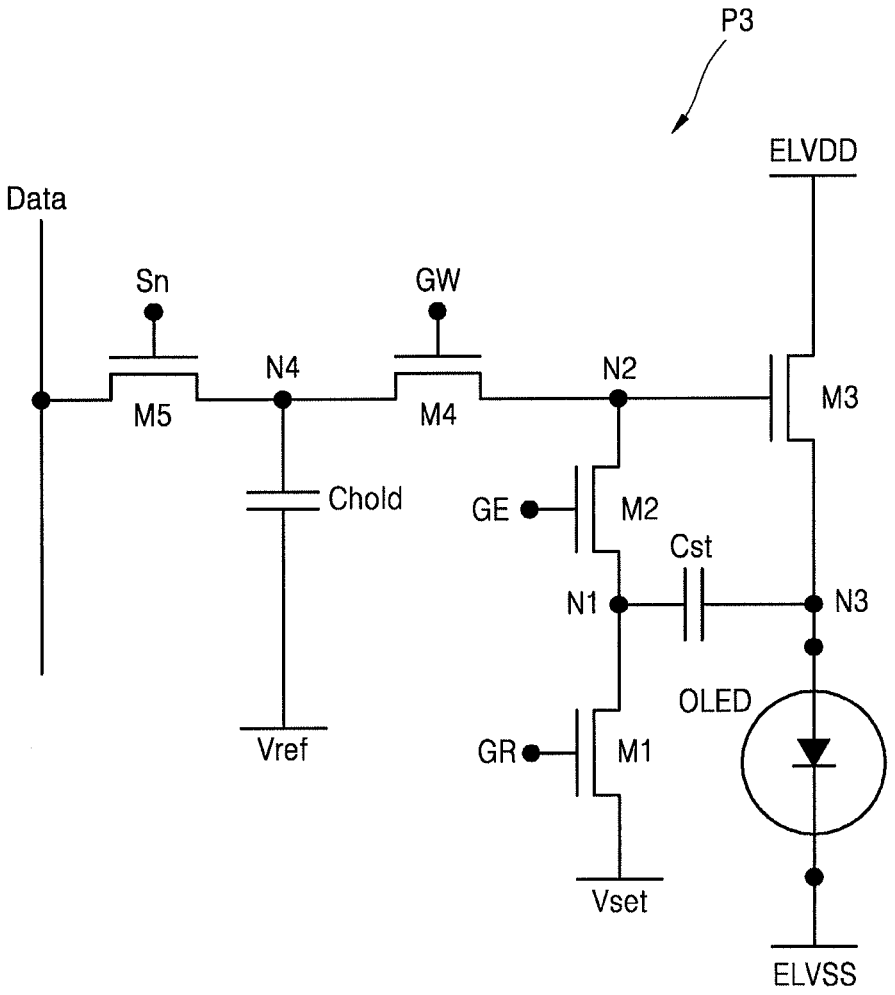
FIG. 5 illustrates another embodiment of a pixel.

FIG. 5 illustrates another embodiment of a pixel P3, which, for example, may be included in the organic light emitting display apparatus 100 of FIG. 1. Referring to FIG. 5, the pixel P3 includes an organic light-emitting diode OLED, and first through fifth transistors M1 through M5 and first and second capacitors Cst and Chold for supplying a current to the organic light-emitting diode OLED.

A first transistor M1 has a first electrode to receive a set voltage Vset and a second electrode connected to a first node N1. The first transistor M1 is turned on when a reset control signal GR is supplied and the reference voltage Vref is supplied to the first node N1.

A second transistor M2 has a first electrode connected to the first node N1 and a second electrode connected to a second node N2. The second transistor M2 is turned on when an emission control signal GE is supplied and electrically connects the first node N1 to the second node N2.

A third transistor M3 has a gate electrode connected to the second node N2, a first electrode connected to third node N3, and the third transistor M3 to receive a first power ELVDD through its second electrode.

A fourth transistor M4 has a first electrode connected to a fourth node N4 and a second electrode connected to the second node N2. The fourth transistor M4 is turned on when a write control signal GW is supplied and electrically connects the second node N2 to the fourth node N4.

A fifth transistor M5 has a first electrode connected to the data line DL and a second electrode connected to the fourth node N4. The fifth transistor M5 is turned on when a scan signal Sn is supplied and electrically connects the data line DL to the fourth node N4.

The first capacitor Cst has a first end connected to the first node N1 and a second end connected to the third node N3. The second capacitor Chold has a first end to receive the reference voltage Vref and a second end connected to the fourth node N4.

During the reset section Reset, the first transistor M1 and the second transistor M2 are turned on and thus a set voltage Vset is applied to each of the first node N1 and the second node N2. The set voltage Vset may denote an external signal other than a signal received from a data line DL.

The set voltage Vset may be a predetermined voltage to turn on the third transistor M3. As the set voltage Vset is applied to the gate electrode of the third transistor M3, the first power ELVDD is applied to the third node N3. Also, during the reset section Reset, the first capacitor Cst is reset as the set voltage Vset and the organic light-emitting diode OLED does not emit light.

During the threshold voltage compensation section Vth, the first transistor M1 and the fourth transistor M4 are turned on and thus the set voltage Vset is applied to the first node N1. Also, the second node N2 is electrically connected to the fourth node N4 and thus a voltage of the fourth node N4 is applied to the second node N2.

The first data voltage Vdata1 held in the second capacitor Chold during a previous frame is applied to the second node N2, since the fourth transistor M4 is turned on during the threshold voltage compensation section Vth. As the first data voltage Vdata1 is applied to the second node N2, the third transistor M3 is turned on and current flows via the third transistor M3. A voltage based on the difference (Vdata1−Vth) between a voltage of the second node N2 and the threshold voltage of the third transistor M3 is applied to the third node N3.

As a result, the first capacitor Cst is charged based on a difference (Vset−(Vdata1−Vth)) between the set voltage Vset applied to the first node N1 and the voltage (Vdata1−Vth) applied to the third node N3. Thus, the first capacitor Cst stores a voltage based on the set voltage Vset, the first data voltage Vdata1, and the threshold voltage Vth of the third transistor M3 during the threshold voltage compensation section Vth.

During the emission section Emission, the second transistor M2 is turned on and thus a voltage of the first capacitor Cst is maintained equal to the voltage charged in the voltage compensation section Vth. Also, a voltage (Vset−(Vdata1−Vth)) of the first capacitor Cst is applied between the second node N2 and the third node N3, namely, between a gate electrode and a source electrode of the third transistor M3.

Also, during the emission section Emission, the first data voltage Vdata1 is applied to the second node N2 and thus the third transistor M3 is turned on. The first power ELVDD is applied with a high level and the second power ELVSS is applied with a low level, and the third transistor M3 supplies a driving current to the organic light-emitting diode OLED, based on the first data voltage Vdata1. The driving current may be calculated based on Equation 3.

$$I=K(V\text{set}-V\text{data1})^2 \quad (3)$$

As such, the pixel emits light based on the set voltage Vset and the first data voltage Vdata1, which are irrelevant to the first voltage ELVDD or the threshold voltage of the driving transistor, thereby increasing uniformity of brightness.

During the scan and data-input section Scan, the second capacitor Chold holds the second data voltage Vdata2 in order to use the second data voltage Vdata2 during a next frame, for example, in order to apply the second data voltage Vdata2 to the second node N2 in a threshold voltage compensation section Vth of the next frame. Thus, the second capacitor Chold may be charged based on the second data voltage Vdata2 when the fifth transistor M5 is turned on.

Figure 6:
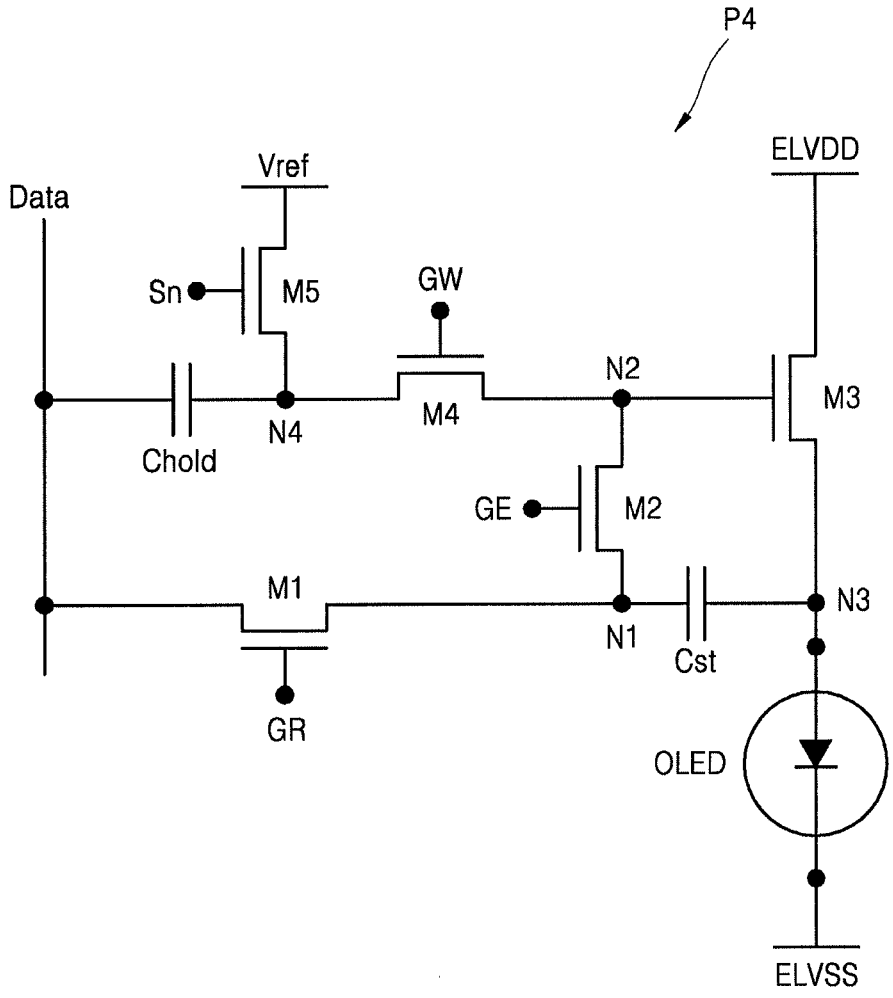
FIG. 6 illustrates another embodiment of a pixel.

FIG. 6 illustrates another embodiment of a pixel P4, which, for example, may be included in the organic light emitting display apparatus 100 of FIG. 1. Referring to FIG. 6, the pixel P4 includes an organic light-emitting diode OLED and first through fifth transistors M1 through M5 and first and second capacitors Cst and Chold for supplying a current to the organic light-emitting diode OLED.

A first transistor M1 has a first electrode connected to a data line DL and a second electrode thereof connected to a first node N1. The first transistor M1 is turned on when a reset control signal GR is supplied and electrically connects the data line DL to the first node N1.

A second transistor M2 has a first electrode connected to the first node N1 and a second electrode connected to a second node N2. The second transistor M2 is turned on when an emission control signal GE is supplied and electrically connects the first node N1 to the second node N2.

A third transistor M3 has a gate electrode connected to the second node N2, a first electrode connected to a third node N3, and a second electrode connected to receive a first power ELVDD. The third transistor M3 supplies a driving current to the organic light-emitting diode OLED for one frame based on a first data voltage.

A fourth transistor M4 has a first electrode connected to a fourth node N4 and a second electrode connected to the second node N2. The fourth transistor M4 is turned on when a write control signal GW is supplied and electrically connects the second node N2 to the fourth node N4.

A fifth transistor M5 has a first electrode to receive a reference voltage Vref and a second electrode connected to the fourth node N4. The fifth transistor M5 is turned on when a scan signal Sn is supplied and the reference voltage Vref is supplied to the fourth node N4.

The first capacitor Cst has a first end connected to the first node N1 and a second end connected to the third node N3. The second capacitor Chold has a first end connected to the data line DL and a second end connected to the fourth node N4.

During the reset section Reset, the first transistor M1 and the second transistor M2 are turned on and thus a reset voltage Vsus is applied to each of the first node N1 and the second node N2. The reset voltage Vsus may be a predetermined voltage to turn on the third transistor M3. As the reset voltage Vsus is applied to the gate electrode of the third transistor M3, the first power ELVDD is applied to the third node N3. Also, during the reset section Reset, the first capacitor Cst is reset as the reference voltage Vref and the organic light-emitting diode OLED does not emit light.

During the threshold voltage compensation section Vth, the first transistor M1 and the fourth transistor M4 are turned on and thus the reset voltage Vsus is applied to the first node N1. Also, the second node N2 is electrically connected to the fourth node N4 and thus a voltage of the fourth node N4 is applied to the second node N2.

A voltage corresponding to a difference (Vref−Vdata1) between the reference voltage Vref and the first data voltage Vdata1 held in the second capacitor Chold during a previous frame, and the reset voltage Vsus supplied from the data line DL connected to one end of the second capacitor Chold, are applied to the second node N2, as the fourth transistor M4 is turned on during the threshold voltage compensation section Vth. A voltage based on the difference (Vref−Vdata1+Vsus−Vth) between a voltage of the second node N2 and the threshold voltage of the third transistor M3 is applied to the third node N3.

As a result, the first capacitor Cst is charged based on a difference (Vsus−(Vref−Vdata1+Vsus−Vth)) between the reset voltage Vsus applied to the first node N1 and the voltage (Vref−Vdata1+Vsus−Vth) applied to the third node N3. Thus, the first capacitor Cst is charged based on the reference voltage Vref, the first data voltage Vdata1, and the threshold voltage Vth of the third transistor M3, during the threshold voltage compensation section Vth.

During the emission section Emission, the second transistor M2 is turned on and thus a voltage of the first capacitor Cst is maintained equal to the voltage charged in the voltage compensation section Vth. Also, a voltage (Vsus−(Vref−Vdata1+Vsus−Vth)) of the first capacitor Cst is applied between the second node N2 and the third node N3, namely, between a gate electrode and a source electrode of the third transistor M3.

Also, during the emission section Emission, the first data voltage Vdata1 is applied to the second node N2 and thus the third transistor M3 is turned on. The first power ELVDD is applied with a high level and the second power ELVSS is applied with a low level, and the third transistor M3 supplies a driving current to the organic light-emitting diode OLED, based on the first data voltage Vdata1. The driving current may be calculated based on Equation 4.

$$I=K(V\text{data1}-V\text{ref})^2 \quad (4)$$

As such, the pixel emits light based on the reference voltage Vref and the first data voltage Vdata1, which are irrelevant to the first voltage ELVDD or the threshold voltage of the driving transistor, thereby increasing uniformity of brightness.

During the scan and data-input section Scan, the second capacitor Chold holds the second data voltage Vdata2 in order to use the second data voltage Vdata2 during a next frame, for example, in order to apply the second data voltage Vdata2 to the second node N2 in a threshold voltage compensation section Vth of the next frame.

Figure 7:
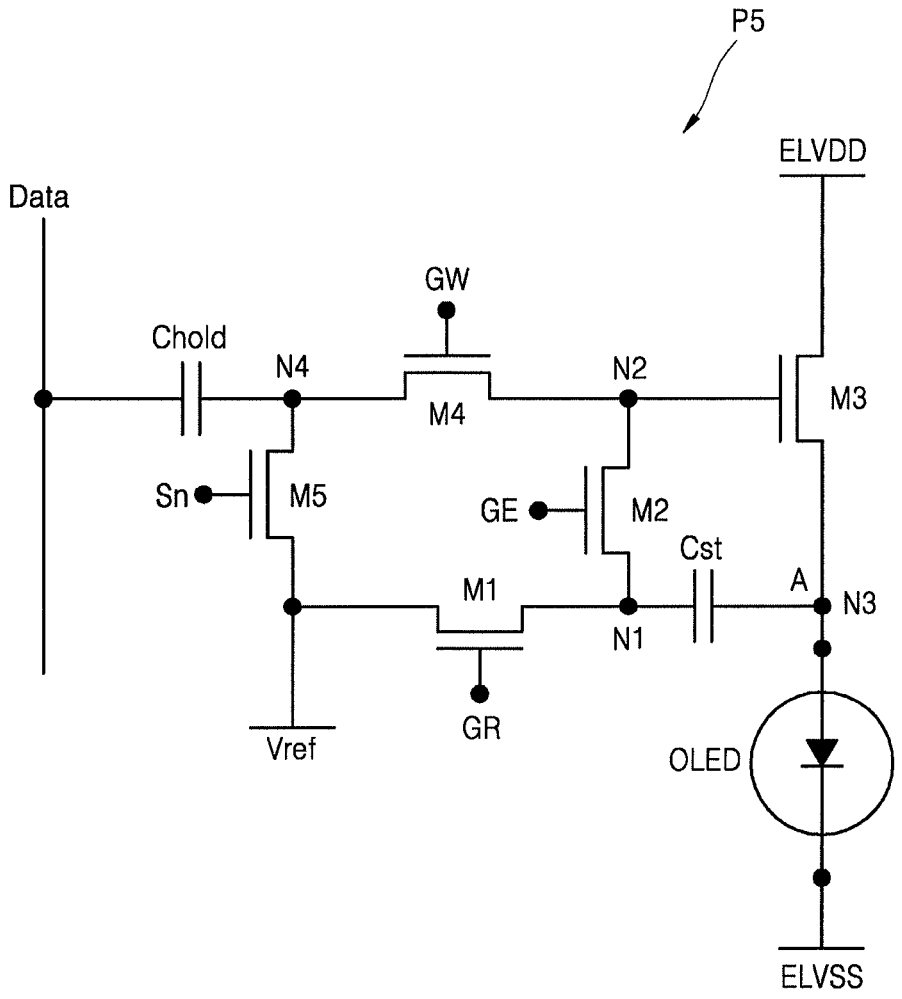
FIG. 7 illustrates another embodiment of a pixel.

FIG. 7 illustrates another embodiment of a pixel P5, which, for example, may be included in the organic light emitting display apparatus 100 of FIG. 1. Referring to FIG.

7, the pixel P5 includes an organic light-emitting diode OLED and first through fifth transistors M1 through M5 and first and second capacitors Cst and Chold for supplying a current to the organic light-emitting diode OLED.

A first transistor M1 has a first electrode to receive a reference voltage Vref and a second electrode connected to a first node N1. The first transistor M1 is turned on when a reset control signal GR is supplied and the reference voltage Vref is supplied to the first node N1.

A second transistor M2 has a first electrode connected to the first node N1 and a second electrode connected to a second node N2. The second transistor M2 is turned on when an emission control signal GE is supplied and electrically connects the first node N1 to the second node N2.

A third transistor M3 has a gate electrode connected to the second node N2, a first electrode connected to a third node N3, and a second electrode to receive a first power ELVDD.

A fourth transistor M4 has a first electrode connected to a fourth node N4 and a second electrode connected to the second node N2. The fourth transistor M4 is turned on when a write control signal GW is supplied and electrically connects the second node N2 to the fourth node N4.

A fifth transistor M5 has a first electrode to receive a reference voltage Vref and a second electrode connected to the fourth node N4. The fifth transistor M5 is turned on when a scan signal Sn is supplied and the reference voltage Vref is supplied to the fourth node N4.

The first capacitor Cst has a first end connected to the first node N1 and a second end connected to the third node N3. The second capacitor Chold has a first end connected to the data line DL and a second end connected to the fourth node N4.

During the reset section Reset, the first transistor M1 and the second transistor M2 are turned on and thus a reference voltage Vref is applied to each of the first node N1 and the second node N2. The reference voltage Vref may be a predetermined voltage to turn on the third transistor M3. As the reference voltage Vref is applied to the gate electrode of the third transistor M3, the first power ELVDD is applied to third node N3. Also, during the reset section Reset, the first capacitor Cst is reset as the reference voltage Vref and the organic light-emitting diode OLED does not emit light.

During the threshold voltage compensation section Vth, the first transistor M1 and the fourth transistor M4 are turned on and thus the reference voltage Vref is applied to the first node N1. Also, the second node N2 is electrically connected to the fourth node N4 and thus a voltage of the fourth node N4 is applied to the second node N2.

A voltage based on the difference (Vref−Vdata1) between the reference voltage Vref and the first data voltage Vdata1 held in the second capacitor Chold during a previous frame, and the reset voltage Vsus supplied from the data line DL connected to one end of the second capacitor Chold, are applied to the second node N2, as the fourth transistor M4 is turned on during the threshold voltage compensation section Vth. A voltage based on the difference (Vref−Vdata1+Vsus−Vth) between a voltage of the second node N2 and the threshold voltage of the third transistor M3 is applied to the third node N3.

As a result, the first capacitor Cst is charged based on a difference (Vref−(Vref−Vdata1+Vsus−Vth)) between the reference voltage Vref applied to the first node N1 and the voltage (Vref−Vdata1+Vsus−Vth) applied to the third node N3. Thus, the first capacitor Cst is charged based on the reset voltage Vsus, the first data voltage Vdata1, and the threshold voltage Vth of the third transistor M3, during the threshold voltage compensation section Vth.

During the emission section Emission, the second transistor M2 is turned on and thus a voltage of the first capacitor Cst is maintained equal to the voltage charged in the voltage compensation section Vth. Also, a voltage (Vref−(Vref−Vdata1+Vsus−Vth)) of the first capacitor Cst is applied between the second node N2 and the third node N3, namely, between a gate electrode and a source electrode of the third transistor M3.

Also, during the emission section Emission, the first data voltage Vdata1 is applied to the second node N2 and thus the third transistor M3 is turned on. The first power ELVDD is applied with a high level and the second power ELVSS is applied with a low level, and the third transistor M3 supplies a driving current to the organic light-emitting diode OLED, based on the first data voltage Vdata1. The driving current may be calculated based on Equation 5.

$$I=K(V\text{data1}-V\text{sus})^2 \tag{5}$$

As such, the pixel emits light based on the reset voltage Vsus and the first data voltage Vdata1, which are irrelevant to the first voltage ELVDD or the threshold voltage of the driving transistor, thereby increasing uniformity of brightness.

During the scan and data-input section Scan, the second capacitor Chold holds the second data voltage Vdata2 in order to use the second data voltage Vdata2 during a next frame, for example, in order to apply the second data voltage Vdata2 to the second node N2 in a threshold voltage compensation section Vth of the next frame.

Figure 8:
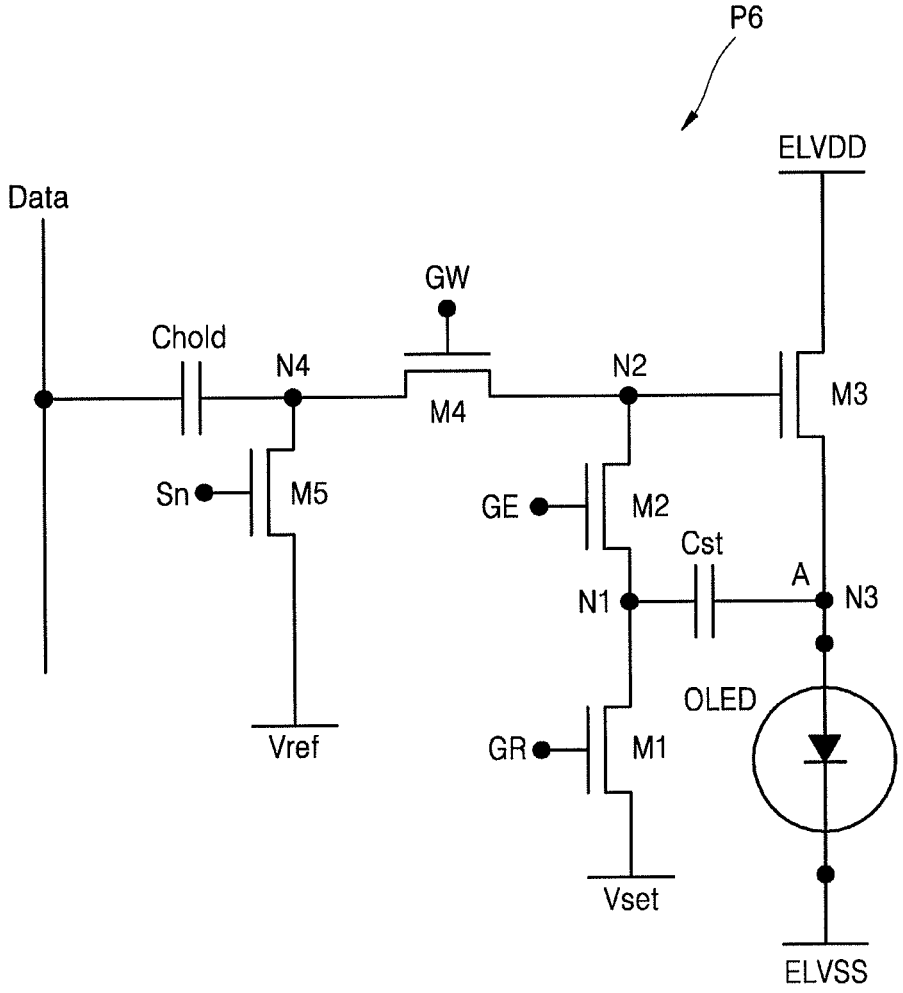
FIG. 8 illustrates another embodiment of a pixel.

FIG. 8 illustrates another embodiment of a pixel P6, which, for example, may be included in the organic light emitting display apparatus 100 of FIG. 1. Referring to FIG. 8, the pixel P6 includes an organic light-emitting diode OLED and first through fifth transistors M1 through M5 and first and second capacitors Cst and Chold for supplying a current to the organic light-emitting diode OLED.

A first transistor M1 has a first electrode to receive a set voltage Vset and a second electrode connected to a first node N1. The first transistor M1 is turned on when a reset control signal GR is supplied and the reference voltage Vref is supplied to the first node N1.

A second transistor M2 has a first electrode connected to the first node N1 and a second electrode connected to a second node N2. The second transistor M2 is turned on when an emission control signal GE is supplied and electrically connects the first node N1 to the second node N2.

A third transistor M3 has a gate electrode connected to the second node N2, a first electrode connected a third node N3, and a second electrode to receive a first power ELVDD.

A fourth transistor M4 has a first electrode connected to a fourth node N4 and a second electrode connected to the second node N2. The fourth transistor M4 is turned on when a write control signal GW is supplied and electrically connects the second node N2 to the fourth node N4.

A fifth transistor M5 has a first electrode to receive a reference voltage Vref and a second electrode connected to the fourth node N4. The fifth transistor M5 is turned on when a scan signal Sn is supplied and the reference voltage Vref is supplied to the fourth node N4.

The first capacitor Cst has a first end connected to the first node N1 and a second end connected to the third node N3. The second capacitor Chold has a first end connected to the data line DL and a second end connected to the fourth node N4.

During the reset section Reset, the first transistor M1 and the second transistor M2 are turned on and thus a set voltage Vset is applied to each of the first node N1 and the second node N2. The set voltage Vset may denote an external signal other than a signal received from a data line DL. The set voltage Vset may be a predetermined voltage to turn on the third transistor M3. As the set voltage Vset is applied to the gate electrode of the third transistor M3, the first power ELVDD is applied to the third node N3. Also, during the reset section Reset, the first capacitor Cst is reset as the set voltage Vset and the organic light-emitting diode OLED does not emit light.

During the threshold voltage compensation section Vth, the first transistor M1 and the fourth transistor M4 are turned on and thus the set voltage Vset is applied to the first node N1. Also, the second node N2 is electrically connected to the fourth node N4 and thus a voltage of the fourth node N4 is applied to the second node N2.

A voltage based on the difference (Vref-Vdata1) between the reference voltage Vref and the first data voltage Vdata1 held in the second capacitor Chold during a previous frame, and the reset voltage Vsus supplied from the data line DL connected to one end of the second capacitor Chold, are applied to the second node N2 as the fourth transistor M4 is turned on during the threshold voltage compensation section Vth. A voltage based on the difference (Vref−Vdata1+Vsus−Vth) between a voltage of the second node N2 and the threshold voltage of the third transistor M3 is applied to the third node N3.

As a result, the first capacitor Cst is charged based on a difference (Vset−(Vref−Vdata1+Vsus−Vth)) between the set voltage Vset applied to the first node N1 and the voltage (Vref−Vdata1+Vsus−Vth) applied to the third node N3. Thus, the first capacitor Cst stores a voltage based on the set voltage Vset, the reset voltage Vsus, the reference voltage Vref, the first data voltage Vdata1, and the threshold voltage Vth of the third transistor M3, during the threshold voltage compensation section Vth.

During the emission section Emission, the second transistor M2 is turned on and thus a voltage of the first capacitor Cst is maintained equal to the voltage charged in the voltage compensation section Vth Also, a voltage (Vset−(Vref−Vdata1+Vsus−Vth)) of the first capacitor Cst is applied between the second node N2 and the third node N3, namely, between a gate electrode and a source electrode of the third transistor M3.

Also, during the emission section Emission, the first data voltage Vdata1 is applied to the second node N2 and thus the third transistor M3 is turned on. The first power ELVDD is applied with a high level and the second power ELVSS is applied with a low level, and the third transistor M3 supplies a driving current to the organic light-emitting diode OLED, based on the first data voltage Vdata1. The driving current may be calculated based on Equation 6.

$$I=K(V\text{data1}+V\text{set}-V\text{sus}-V\text{ref})^2 \quad (6)$$

As such, the pixel emits light based on the reference voltage Vref, the set voltage Vset, the reset voltage Vsus, and the first data voltage Vdata1, which are irrelevant to the first voltage ELVDD or the threshold voltage of the driving transistor, thereby increasing uniformity of brightness.

During the scan and data-input section Scan, the second capacitor Chold holds the second data voltage Vdata2 in order to use the second data voltage Vdata2 during a next frame, for example, in order to apply the second data voltage Vdata2 to the second node N2 in a threshold voltage compensation section Vth of the next frame.

In the embodiments of FIGS. 2 and 4-8, the first through fifth transistors M1 through M5 may be implemented by using NMOS transistors. In other corresponding embodiments, PMOS transistors may be used.

The methods, processes, and/or operations described herein may be performed by code or instructions to be executed by a computer, processor, controller, or other signal processing device. The computer, processor, controller, or other signal processing device may be those described herein or one in addition to the elements described herein. Because the algorithms that form the basis of the methods (or operations of the computer, processor, controller, or other signal processing device) are described in detail, the code or instructions for implementing the operations of the method embodiments may transform the computer, processor, controller, or other signal processing device into a special-purpose processor for performing the methods herein.

The control unit and other processing features of the disclosed embodiments may be implemented in logic which, for example, may include hardware, software, or both. When implemented at least partially in hardware, the control unit and other processing features may be, for example, any one of a variety of integrated circuits including but not limited to an application-specific integrated circuit, a field-programmable gate array, a combination of logic gates, a system-on-chip, a microprocessor, or another type of processing or control circuit.

When implemented in at least partially in software, the control unit and other processing features may include, for example, a memory or other storage device for storing code or instructions to be executed, for example, by a computer, processor, microprocessor, controller, or other signal processing device. The computer, processor, microprocessor, controller, or other signal processing device may be those described herein or one in addition to the elements described herein. Because the algorithms that form the basis of the methods (or operations of the computer, processor, microprocessor, controller, or other signal processing device) are described in detail, the code or instructions for implementing the operations of the method embodiments may transform the computer, processor, controller, or other signal processing device into a special-purpose processor for performing the methods described herein.

Also, another embodiment may include a computer-readable medium. e.g., a non-transitory computer-readable medium, for storing the code or instructions described above. The computer-readable medium may be a volatile or non-volatile memory or other storage device, which may be removably or fixedly coupled to the computer, processor, controller, or other signal processing device which is to execute the code or instructions for performing the method embodiments described herein.

In accordance with one or more of the aforementioned embodiments, a light-emission operation and a data write operation (for example, data holding) may be simultaneously performed, and a data write (for example, data holding) time may be changed during one frame. Thus, a favorable charging and emission time may be achieved, for example, in a manner suitable for use in high-resolution large-sized panels. Also, power consumption for emission may be reduced.

In accordance with one or more of the aforementioned embodiments, during a current frame, when a second data voltage which is to be used during a next frame is held in a hold capacitor Chold, no voltage scaling is performed by a serial connection between a first capacitor and a second capacitor. Thus, the size of the hold capacitor Chold may be reduced decrease and a desired aperture ratio may be easily achieved.

Example embodiments have been disclosed herein, and although specific terms are employed, they are used and are to be interpreted in a generic and descriptive sense only and not for purpose of limitation. In some instances, as would be apparent to one of skill in the art as of the filing of the present application, features, characteristics, and/or elements described in connection with a particular embodiment may be used singly or in combination with features, characteristics, and/or elements described in connection with other embodiments unless otherwise indicated. Accordingly, it will be understood by those of skill in the art that various changes in form and details may be made without departing from the spirit and scope of the invention as set forth in the following claims.

What is claimed is:

1. An organic light-emitting display apparatus, comprising:

a pixel connected to a scan line, a data line, and a power line and including a driving transistor, an emission control transistor, and an organic light-emitting diode to emit light based on a first data voltage; and a power supply to apply different levels of power to the pixel during one frame, wherein the emission control transistor is connected to a gate terminal of the driving transistor and wherein the pixel is to hold a second data voltage to be used during a next frame when the organic light-emitting diode is to emit light based on the first data voltage during the one frame, wherein the pixel includes:

a first transistor connected between the data line and a first node and to turn on based on a reset control signal;

a second transistor, corresponding to the emission control transistor, connected between the first node and a second node and to turn on based on an emission control signal;

a third transistor, corresponding to the driving transistor, connected to a first power source and a third node and to supply a driving current to the organic light-emitting diode based on the first data voltage;

a fourth transistor connected between the second node and a fourth node and to turn on based on a write control signal;

a fifth transistor connected between the data line and the fourth node and to turn on based on a scan signal;

a first capacitor connected between the first node and the third node; and a second capacitor connected between a reference power source and the fourth node, wherein the organic light-emitting diode has an anode connected to the third node and a cathode connected to a second power source.

2. The apparatus as claimed in claim 1, wherein the first capacitor is to be charged based on a reset voltage from the data line, the first data voltage, and a threshold voltage of the third transistor when the first transistor and the fourth transistor are turned on.

3. The apparatus as claimed in claim 1, wherein the second capacitor is to be charged based on the second data voltage when the fifth transistor is turned on.

4. The apparatus as claimed in claim 1, wherein the first through fifth transistors are Negative Metal Oxide Semiconductor (NMOS) transistors.

* * * * *